US010569148B2

(12) United States Patent
Gauvin

(10) Patent No.: US 10,569,148 B2
(45) Date of Patent: Feb. 25, 2020

(54) GOLF TEE FOR GUIDING A BALL

(71) Applicant: Nova Strate Inc., Lac-Brome, Quebec (CA)

(72) Inventor: Serge Gauvin, Lac-Brome (CA)

(73) Assignee: NOVA STRATE INC., Lac-Brome (CA)

( * ) Notice: Subject to any disclaimer, the term of this patent is extended or adjusted under 35 U.S.C. 154(b) by 0 days.

(21) Appl. No.: 15/898,333

(22) Filed: Feb. 16, 2018

(65) Prior Publication Data

US 2018/0236328 A1 Aug. 23, 2018

Related U.S. Application Data

(60) Provisional application No. 62/460,681, filed on Feb. 17, 2017.

(51) Int. Cl.
*A63B 57/19* (2015.01)
*A63B 57/12* (2015.01)

(52) U.S. Cl.
CPC ..... *A63B 57/19* (2015.10); *A63B 57/12* (2015.10); *A63B 2209/00* (2013.01)

(58) Field of Classification Search
CPC ..... A63B 57/10; A63B 57/19; A63B 2209/00; A63B 57/12
See application file for complete search history.

(56) References Cited

U.S. PATENT DOCUMENTS 1,542,505 A * 6/1925 Jacobus ..... A63B 57/10 473/401
1,562,216 A * 11/1925 Flaherty ..... A63B 57/10 473/401
1,588,038 A * 6/1926 Miller ..... A63B 57/10 473/401
1,671,813 A * 5/1928 Clarke ..... A63B 57/19 473/403
1,679,579 A * 8/1928 Lundy ..... A63B 57/10 473/396
2,531,470 A * 11/1950 Rickard ..... A63B 57/13 473/396
3,001,529 A * 9/1961 Watson ..... A24F 13/22 131/257
3,424,457 A * 1/1969 Robertson ..... A63B 57/10 473/257
3,559,998 A * 2/1971 Kelly ..... A63B 57/13 473/396
3,633,919 A * 1/1972 Liccardello ..... A63B 57/0037 473/386
4,951,945 A * 8/1990 Gamble ..... A63B 57/10 473/400

(Continued)

*Primary Examiner* — Steven B Wong
(74) *Attorney, Agent, or Firm* — Brouillette Legal Inc.; Robert Brouillette

(57) ABSTRACT

A golf tee for guiding the trajectory of a golf ball is described herein. The golf tee comprises a penetrating element located at the bottom of a stem which allows the insertion of the golf tee into the ground surface and an angled launch platform adapted to guide the ball when hit by a golf club. The launch platform generally comprises a depression and a launch ramp adapted to receive and retain a golf ball. The golf tee generally improves the golf ball's trajectory by imparting proper spin which allows the ball to remain longer in the air.

19 Claims, 4 Drawing Sheets

(56) References Cited

U.S. PATENT DOCUMENTS

| | | | | | |
|---|---|---|---|---|---|
| 5,193,803 | A * | 3/1993 | Flick, III | A63B 57/10 | 473/392 |
| 5,383,668 | A * | 1/1995 | Andrikian | A63B 57/19 | 473/132 |
| 5,588,448 | A * | 12/1996 | Photakis | A24F 13/22 | 131/259 |
| 5,738,598 | A * | 4/1998 | Wu | A63B 57/19 | 473/392 |
| 6,280,350 | B1 * | 8/2001 | Chung | A63B 57/10 | 473/387 |
| 6,849,008 | B1 * | 2/2005 | Wang | A63B 57/10 | 473/401 |
| 6,960,143 | B2 * | 11/2005 | Sato | A63B 57/10 | 473/387 |
| D526,371 | S * | 8/2006 | Bayfield | D21/718 | |
| 7,338,394 | B2 * | 3/2008 | Harris | A63B 57/19 | 473/387 |
| 8,029,387 | B2 * | 10/2011 | Breton | A63B 57/10 | 473/387 |
| 9,180,351 | B2 * | 11/2015 | Reams | A63B 57/10 | |
| D851,716 | S * | 6/2019 | Pretorius | D21/718 | |
| 2008/0182684 | A1 * | 7/2008 | Carroll | A63B 57/10 | 473/398 |

* cited by examiner

GOLF TEE FOR GUIDING A BALL

CROSS-REFERENCE TO RELATED APPLICATIONS

The present patent application claims the benefits of priority of U.S. Provisional Patent Application No. 62/460,681, entitled "GOLF TEE FOR GUIDING A BALL", and filed at the United States Patent and Trademark Office on Feb. 17, 2017, the content of which is incorporated herein by reference.

FIELD OF THE INVENTION

The present device relates to golf tees. More particularly, the present invention relates to trajectory correcting golf tees.

BACKGROUND OF THE INVENTION

When a golf club of a golf player does not properly hit a golf ball supported by a golf tee, the golf ball is typically deviated from a proper trajectory. Indeed, it may take several years for one practising the sport of golf to develop the required technique or expertise to properly hit the ball to give a desired trajectory. The required time investment dedicated to practising a swing and the resulting frustration of not hitting a ball properly are main causes for which many people quickly quit playing golf.

It is now known in the art that the swing path of a golfer and the angle at which the golf club hits a golf ball are considered majors parameters impacting the trajectory of the golf ball being hit. Thus, some researches shown that 80% of the unintentional veering of the golf ball is related to the face of a driver club hitting the ball at an angle other than 90 degrees. Furthermore, the said researches also revealed that only about 20% of unintentional veering is due to a misaligned swing path of a golf club. The combination of these two factors tends to induce a side spin about a vertical axis of the ball. Such side spin generally results in a curved flight path and a reduction of a ball's roll distance.

Generally, the tee golf includes a body having a pointed tip and a concave head.

Hence, there is a need for an improved golf tee which mitigates the shortcomings of prior art golf tees.

SUMMARY OF THE INVENTION

The aforesaid and other objectives of the present invention are realized by generally providing a golf tee aiming at improving the addressing of a golf ball and aiming at improving a golf ball's trajectory by imparting proper spin allowing the ball to remain longer in the air, typically by increasing back spin effect, while following a straighter flight path.

In another aspect of the invention, the tee golf aims at improving a golf ball's launch angle upon a missed ball-hitting angle. At the time of present writing, the official USGA regulations (Appendix IV—Devices and other equipment) stipulate, among other things, that "A tee must not be designed or manufactured in such a way that it could indicate line of play or unduly influence the movement of the ball." The said rule has been unchanged for decades and still applies to professional and/or generally to amateur golfers. In the last years, the said amateur golfers evolved from individuals dedicated to improving their game to individual playing only to enjoy the game or to have fun on the golf course without aiming at becoming good and/or better players.

Furthermore, the present invention aims at reducing at least one of the forces responsible for a curved flight path of a golf ball. It is believed that such reduction of the forces responsible for curved trajectory might reduce the learning curve of golf players and thus aiming at improving the level of fun among amateur golfers.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

Figure 1:
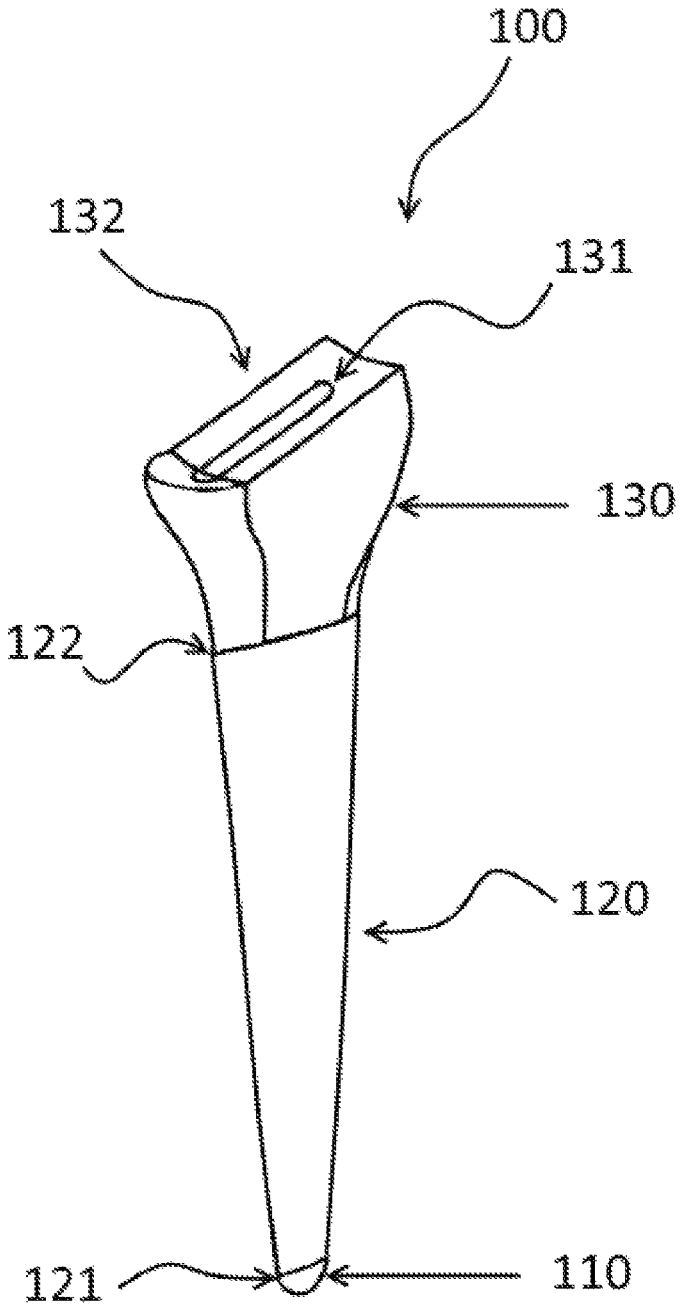
FIG. 1 is a perspective view of an embodiment of a trajectory correcting golf tee.
Figure 4:
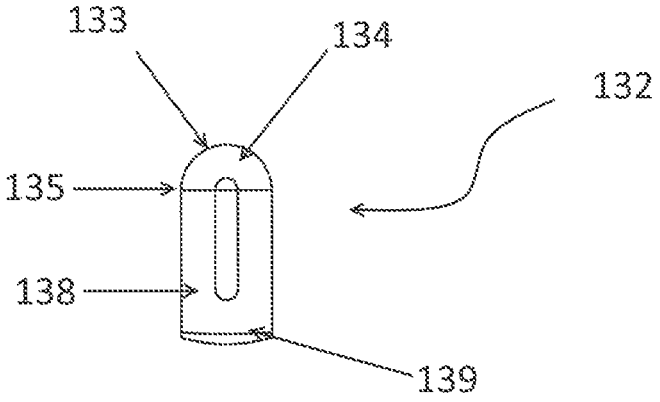
FIG. 4 is a top view of the trajectory correcting golf tee as shown in FIG. 1.
Figure 3:
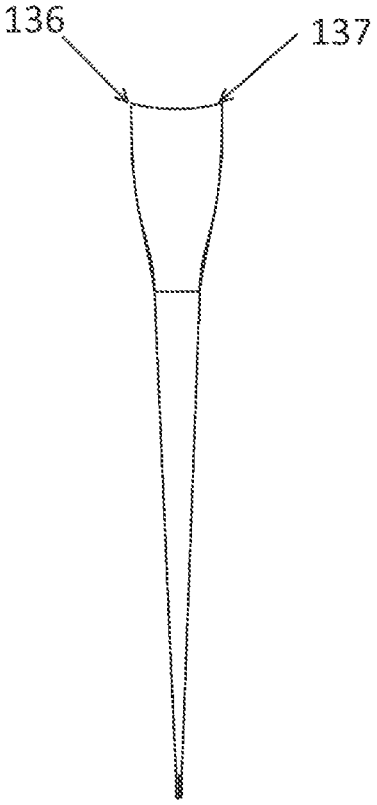
FIG. 3 is a front view of the trajectory correcting golf tee as shown in FIG. 1.

A novel golf tee for guiding a ball will be described hereinafter. Although the invention is described in terms of specific illustrative embodiments, it is to be understood that the embodiments described herein are by way of example only and that the scope of the invention is not intended to be limited thereby.

Now referring to FIGS. 1 to 4, a preferred embodiment of a golf tee 100 is illustrated. The golf tee 100 comprises a penetrating portion 110, a stem 120 and a launch platform 130. The penetrating portion 110 is located at one end 121 of the golf tee 100, generally being the bottom end of the stem 120. In a preferred embodiment, the penetrating portion 110 is shaped to ease the penetration of the portion 110 into the ground surface. The said shape generally aims at allowing the insertion of the tee golf 100 into a desired position while providing some resistance to the impact of the driver club.

Still referring to FIGS. 1 to 4, the launch platform 130 is attached or is an extension of the top end 122 of the stem 120. The launch platform 130 is generally adapted and/or shaped to receive and/or hold in place a golf ball. The launch platform 130 comprises a launch ramp 132 generally shaped or adapted to form a depression 131. In a preferred embodiment, the launch ramp 132 comprises a lower curved or rounded edge 133, a top edge 139 and side edges 136 and 137. The edges 133, 136, 137 and 139 are generally higher than the launch ramp 132 to form the depression 131.

The launch ramp 132 further comprises a retainer portion 134 adapted to hold or retain a golf ball. In a preferred embodiment, the retainer portion 134 is concave or curved portion having a radius adapted to the used golf ball. The launch ramp 132 further comprises a curved bottom edge 135 creating an angle between the retainer portion 134 and the remaining of the launch ramp 132.

The side edges 136 and 137 are preferably adapted to allow guiding of the golf ball once the ball is hit by a golf club. The surface extending between both side edges 136 and 137 and being limited by the bottom edge 135 and a top edge 139 defines a laterally curved section 138 aiming at improving the trajectory of the golf ball by imparting proper spin which allows the ball to remain longer in the air while following a straighter flight path.

In a preferred embodiment, the laterally curved section 138 is calculated using the radius of a golf ball, aiming at maximizing contact during launch.

Figure 2:
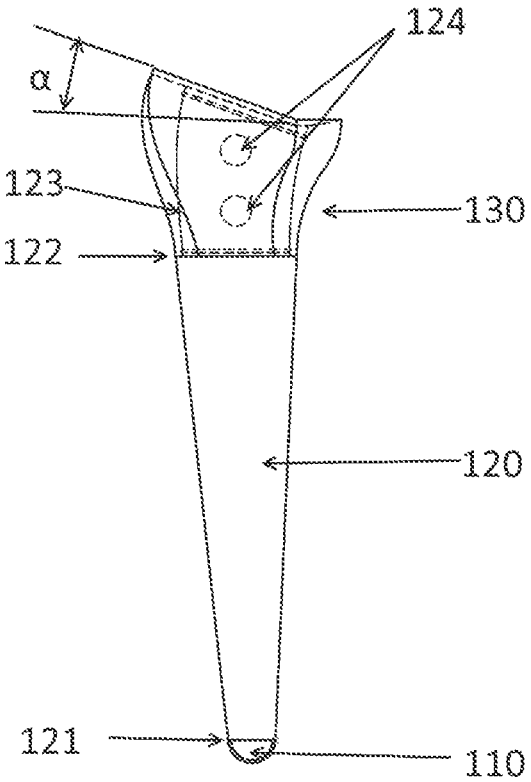
FIG. 2 is a side view of the trajectory correcting golf tee as shown in FIG. 1.

The top portion of the stem 122 preferably comprises an elongated member 123, such as a protrusion or extension, adapted to attach the launch platform 130 to the stem 120. In a preferred embodiment, the elongated member 123 is integral with the stem 120. When manufacturing the golf tee 100, the launch platform 130 is moulded over the elongated member 123, aiming at providing a durable and integral construction. As shown in FIG. 2, a side of the elongated member 123 may comprise a base portion and a top portion. In some embodiments, the bottom portion is narrower than the top portion of the elongated member 123.

In a preferred embodiment, launch ramp 132 is shaped to form a depression 131 or at least part of a depression 131 (see FIG. 1). The depression 131 is typically formed along the length of the launch ramp 132, thus guiding the trajectory of the ball toward the upper portion of launch ramp 132 when the ball is hit. The lower portion of launch ramp 132 (in the current embodiment retainer portion 134) is preferably shaped as to retain the ball on the golf tee 100. In the preferred embodiment, lower (or retainer) portion 134 of depression 131 is shaped as a cup or half-cup. The upper portion of launch ramp 132 (in the current embodiment laterally curved section 138) is preferably U-shaped or curved as to guide the golf ball.

In other embodiments, the launch platform 130 and the stem 120 may be integral and form a single rigid structure.

In yet other embodiments, the launch platform 130 may be attached or fixed to the elongated member 123 and/or to the stem 120 to provide a durable and integral construction.

In a preferred embodiment, the stem 120 is made with a rigid and impact resistant material, such as, but not limited to an impact resistant polymer, wood, metal or composite material, and the launch platform 130 is preferably made of any type of material having rubber-like characteristics, such as but not limited to polymer.

The launch ramp is generally inclined about an angle $\alpha$ with regard to the ground or a horizontal axis. In some embodiments, the angle $\alpha$ may be between 10 and 30 degrees and in a preferred embodiment, the angle $\alpha$ is about 20 degrees. The angle is preferably selected to maximize the correction of the direction of the golf ball toward the target and the support or holding property of the golf tee 100.

In a preferred embodiment, the stem 120 is preferably made of polycarbonate.

The golf tee 100 is generally used as other prior art golf tees. As such, the golf player inserts the bottom portion 110 in the ground. In a preferred embodiment, the golf tee is inserted at about 90-degree angle with the ground surface so that the launch ramp 132 is oriented towards the target. The golf player then pushes the golf tee into the ground until a desired remainder height of the stem 120 is obtained. The golf player may then position the ball on the launch platform and use a golf club, such as a driver club, to hit the positioned ball. Thus, the ball, initially retained at the depression 131, slides over the launch ramp before launching in the air. During the sliding of the ball from the lower curved or rounded edge 133 to a top edge 139 of the launch ramp, the side edges 136 and 137 reduce the side spin of the golf ball.

Understandably, in another embodiment where the stem has a shape allowing rotation, such as a cylindrical shape, the golf tee is inserted at about 90-degree angle with the ground surface. The golf player then pushes the golf tee into the ground until a desired remainder height of the stem is obtained. If not well aligned, the golf tee may then be rotated about a vertical axis so that the launch ramp 132 is oriented towards the target.

In yet another embodiment, the inclined launch ramp 132 creates friction which reduces the side spin of the golf ball when hit. In such an embodiment, at least some energy is transferred to or absorbed by the rubber-like material of the launch platform 130 and the concaved launch ramp 132 aims at correcting the trajectory of the golf ball by guiding the ball towards the target.

In still another embodiment, the penetrating element 110 may have any shape allowing an appropriate insertion of the tee to the ground.

Figure 5:
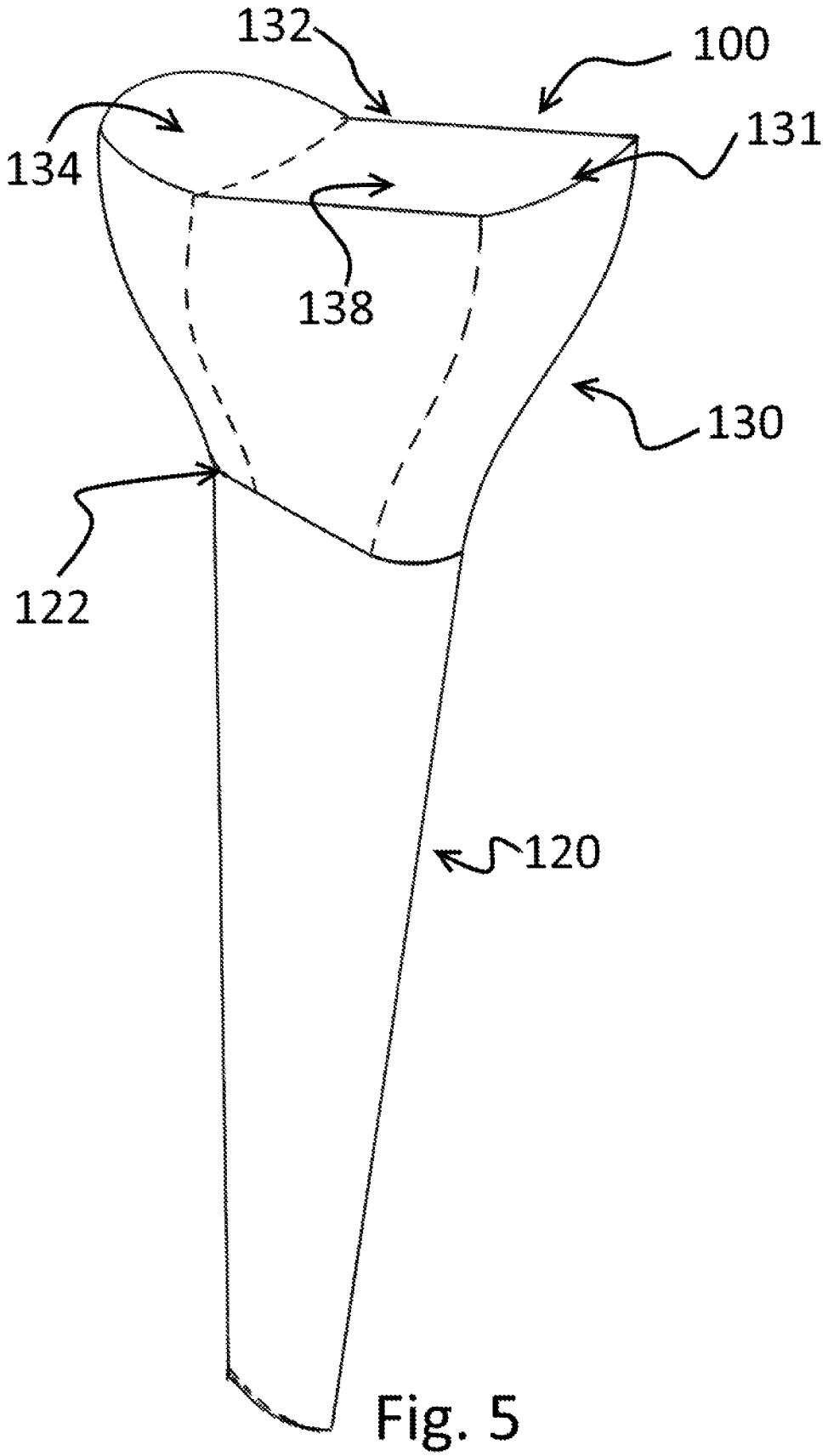
FIG. 5 is a perspective view of an embodiment of a trajectory correcting golf tee in accordance with the principles of the present invention.

In another embodiment, the stem 120 may have any shape allowing an appropriate hitting of the golf ball and an appropriate insertion of the tee to the ground, such as a blade shape as shown in FIGS. 1 and 5.

In a further embodiment, the launch platform 130 may be made of any resistant impact material, which is adapted to absorb some impact energy, such as but not limited to rubber-like material.

Figure 6:
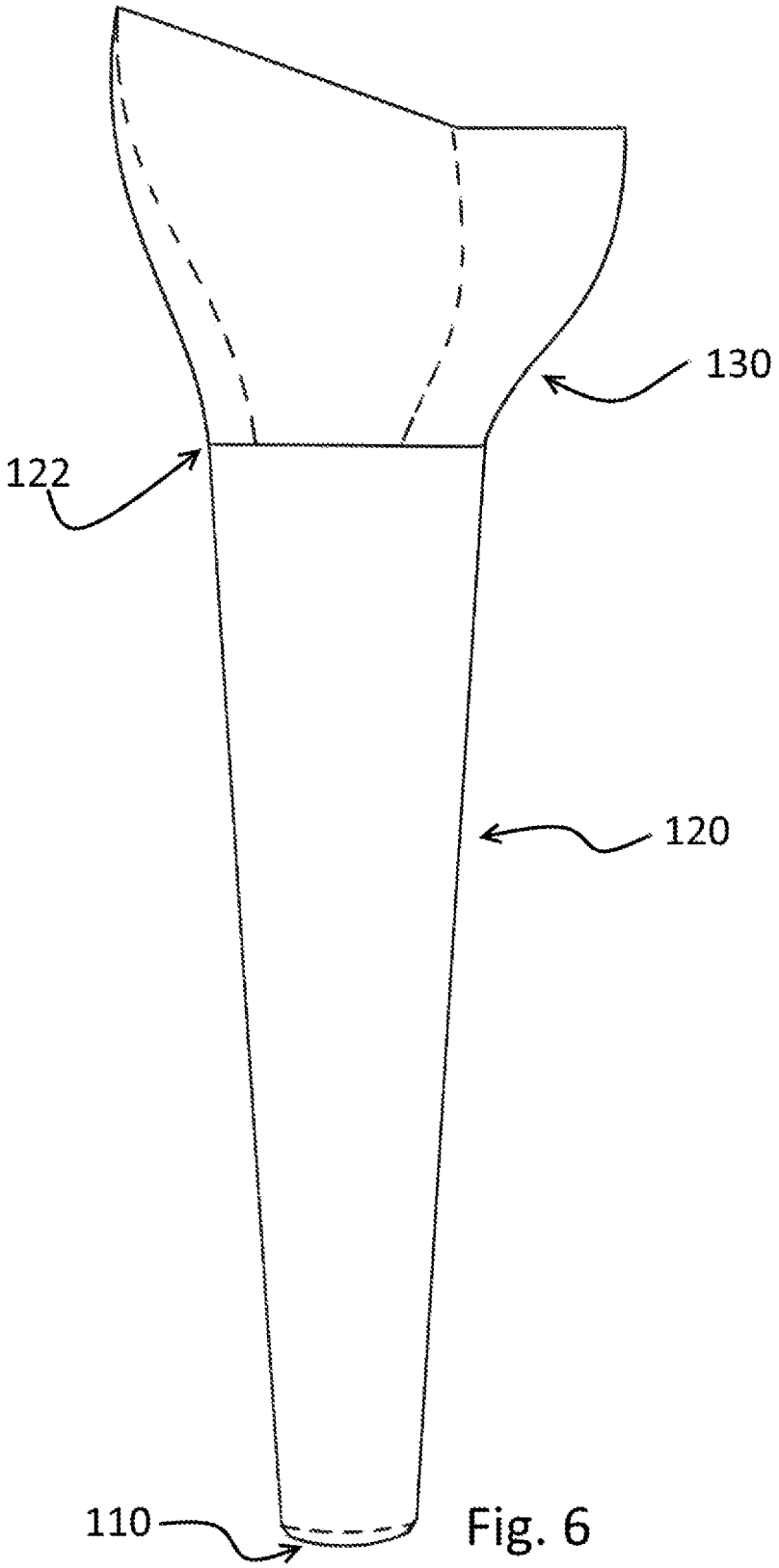
FIG. 6 is a side view of the trajectory correcting golf tee as shown in FIG. 5.

Now referring to FIGS. 5 and 6, an embodiment of a golf tee 100 is illustrated. The golf tee 100 comprises a penetrating portion 110, a stem 120 and a launch platform 130. The penetrating portion 110 is located at one end 121 of the golf tee 100, generally being the bottom end of the stem 120. As shown in FIGS. 5 and 6, one skilled in the art shall understand that the present invention comprises golf tees 100 having different shapes or formats according to the needs of the user.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A golf tee comprising a rigid ground-piercing stem and a head extending from such stem, the head being made of a resilient material, the head comprising a launch ramp with a lower and an upper portion, wherein:

the lower portion is configured to hold in place a golf ball once the stem is planted in a ground; and the upper portion extends from the lower portion at an upward angle relative to the ground when the stem is planted in such ground to form a continuous channel, the upper portion comprising two edges and having a radius of curvature substantially equivalent to the radius of the golf ball, the upper portion being adapted to contact the golf ball from one of the edges to the other edge;

the movement of the golf ball induced by an impact of a golf club on the golf ball creating friction with the resilient material of the head, the created friction affecting side spinning of the golf ball.

2. The golf tee of claim 1, wherein the upper portion of the launch ramp is elongated and concave-shaped, the concave shape being adapted to directly contact with the periphery of the golf ball.

3. The golf tee of claim 1, wherein the upward angle is at least 10 deg.

4. The golf tee of claim 1, wherein the upward angle does not exceed 30 deg.

5. A golf tee comprising a rigid ground-piercing stem and a head extending from such stem, the head comprising an elongated depression with a lower and an upper portion, the head being made of a resilient material, wherein:

the lower portion is bowl-shaped; and the upper portion extends from the lower portion at an upward angle relative to the ground when the stem is planted in such ground, the upper portion comprising two edges and having a radius of curvature substantially equivalent to the radius of a golf ball, the upper portion being adapted to contact the golf ball from one of the edges to the other edge;

the movement of the golf ball induced by an impact of a golf club on the golf ball creating friction with the resilient material of the head, the created friction affecting side spinning of the golf ball.

6. The golf tee of claim 5, wherein the upward angle is at least 10 deg.

7. The golf tee of claim 5, wherein the upward angle does not exceed 30 deg.

8. A method of correcting a trajectory of a golf ball using a tee, the method comprising:

a) positioning a resilient launch platform of the tee so that the resilient launch platform is oriented in a desired direction;

b) inserting a rigid ground-piercing stem in the ground at the position of the resilient launch platform of the tee;

c) placing the golf ball over a lower portion of the resilient launch platform of the tee;

d) hitting the placed golf ball to direct the golf ball to contact from one edge of a concave surface to another edge of the concave surface of an upper portion of the resilient launch platform, the upper portion being at an upward angle relative to the lower portion and forming a continuous surface with the lower portion, the concave portion having a radius of curvature substantially equivalent to the radius of the golf ball;

e) creating friction between the resilient launch platform and the hit golf ball; and f) the created friction affecting side spinning of the hit golf ball.

9. The method of correcting a trajectory of a golf ball using a tee according to claim 8, wherein the upward angle is at least 10 deg.

10. The method of correcting a trajectory of a golf ball using a tee according to claim 8, wherein the upward angle does not exceed 30 deg.

11. The method of correcting a trajectory of a golf ball using a tee according to claim 8, wherein the upper portion extends in a desired direction of travel of the golf ball after such golf ball has been struck by a golf club.

12. The golf tee of claim 1, the stem further comprising an elongated member adapted to attach the head to the stem.

13. The golf tee of claim 12, the head being molded over the elongated member.

14. The golf tee of claim 12, the elongated member comprising a bottom portion and a top portion, the bottom portion being narrower than the top portion.

15. The golf tee of claim 1, the head being made of a polymeric material.

16. The golf tee of claim 1, the stem having a blade shape.

17. The method of claim 8, the absorbing of energy further comprising creating friction between the golf ball and the upper portion.

18. The method of claim 8, the absorbing of energy further comprising the absorbed energy deforming the resilient launch platform.

19. The golf tee of claim 1, the upper portion comprising an elongated concave-shaped portion, the concave-shape portion being surrounded by the two edges and the radius of curvature of the concave-shaped portion being substantially equivalent to the radius of the golf ball, the concave-shaped portion creating friction between the golf ball and the upper portion.

* * * * *